US007070322B1

(12) United States Patent
Field et al.

(10) Patent No.: US 7,070,322 B1
(45) Date of Patent: Jul. 4, 2006

(54) SAFETY WRISTWATCH SYSTEM

(76) Inventors: Jean Marie Field, 8 Grove St., Cos Cob, CT (US) 06807; Clifford A. Scott, 8 Grove St., Cos Cob, CT (US) 06807

( * ) Notice: Subject to any disclaimer, the term of this patent is extended or adjusted under 35 U.S.C. 154(b) by 48 days.

(21) Appl. No.: 10/835,627

(22) Filed: Apr. 30, 2004

Related U.S. Application Data

(63) Continuation-in-part of application No. 09/996,450, filed on Nov. 29, 2001, now abandoned.

(51) Int. Cl.
*A44C 5/00* (2006.01)
*G04B 37/00* (2006.01)

(52) U.S. Cl. ..... 368/281; 368/282; 224/164

(58) Field of Classification Search ..... 368/88, 368/280, 281, 282; 224/164, 170, 174, 179
See application file for complete search history.

(56) References Cited

U.S. PATENT DOCUMENTS

| | | | | |
|---|---|---|---|---|
| 4,130,987 | A | 12/1978 | Schickedanz | |
| 4,178,751 | A | 12/1979 | Liautaud | |
| 4,457,460 | A | 7/1984 | Hirsch et al. | |
| 4,511,260 | A | 4/1985 | Pasquier | |
| D285,543 | S | 9/1986 | Moser | |
| 4,615,185 | A | 10/1986 | Bollinger | |
| 4,779,249 | A | 10/1988 | Rappaport | |
| 5,332,135 | A | 7/1994 | Fletcher | |
| D366,036 | S | 1/1996 | Houlihann | |
| D394,394 | S | 5/1998 | Bruce et al. | |
| 5,931,764 | A | 8/1999 | Freeman et al. | |
| 5,940,349 | A | 8/1999 | Stewart | |
| 6,216,490 | B1 | 4/2001 | Radley-Smith | |
| D445,041 | S | 7/2001 | Tan et al. | |
| D456,724 | S | 5/2002 | Wilson | |
| 6,388,612 | B1 | 5/2002 | Neher | |
| 6,728,166 | B1 * | 4/2004 | Grupp | 368/69 |
| 6,857,775 | B1 * | 2/2005 | Wilson | 368/281 |

* cited by examiner

*Primary Examiner*—Vit W. Miska
(74) *Attorney, Agent, or Firm*—Collard & Roe, P.C.

(57) ABSTRACT

A snag-free or safety instrument, such as a wristwatch, having substantially smooth and flowing contours and being free of stems and protrusions eliminates or greatly reduces the potential of state of the art wristwatches to scratch, puncture or tear the skin of persons other than the wearer whom the watch may contact, when worn in normal use and in situations involving possible close contacts as in care giving and sports activities.

12 Claims, 2 Drawing Sheets

SAFETY WRISTWATCH SYSTEM

CROSS REFERENCE TO RELATED APPLICATIONS

This application is a Continuation-In-Part of U.S. Ser. No. 09/996,450 filed Nov. 29, 2001, abandoned, entitled "Snag-Free Wristwatch".

BACKGROUND OF THE INVENTION

1. Field of the Invention

The present invention relates to a snag-free or safety wristwatch system and in particular to a safety wristwatch system free of protruding elements and external stems, which prevents injuries and infection upon contact with persons other than the wearer.

2. The Prior Art

Commonly worn wristwatches often incorporate elements that may bruise, snag or tear the exposed skin of persons whom the wearer of the watch may contact. Clothing may be pulled, which can also cause skin damage. The potentially harmful elements of wristwatches may include the watch case itself, the bezel, the crystal, the hinges, the stems, the stem knobs, the horns or lugs for bracelet or strap attachments, the bracelets or straps themselves, other attachments including ornamentation and insignia, clasps, including buckles and arrangements using hook and loop fasteners of the type generally known as VELCRO which can scratch and scrape the skin, and the shape and bulk of the watch itself, including watches with excessively high profiles, widths or hard, sharp edges.

Although brushing against or being struck by a worn wristwatch may cause skin tears and damage at any time, skin damage is relatively more likely to occur in situations such as the feeding, care and handling of infants and children, assisting and caring for the ill, aged and other persons with brittle skin and dermatological problems, and in events involving the possibilities of hard contact, e.g., certain athletic activities. This problem is important: skin scrapes, tears, punctures and contusions can be highly dangerous where healing processes may be slow or problematic and/or the potentials or likelihoods exist for infection.

Many health care practitioners recognize the seriousness of this issue. Rules, however, regarding the wearing of wristwatches while performing certain tasks are difficult to enforce and limited in application. Moreover, despite this long standing problem, there has been no satisfactory solution.

Works directed to the field of wristwatches are found in Class 224: Package and article carriers, and several of its subclasses, including subclasses 160, 170 and 174.

This Class includes a wide variety of improvements to wristwatch manufacture, bands and bracelets, attachments thereto, extensions, interchangeability of bands and bracelets, assembly, and other features. None have been found which do not retain or incorporate features that may scratch or tear skin.

Patents in this class, such as U.S. Pat. No. 4,457,460, address protection of the wearer from injury by the wristwatch, and others such as U.S. Pat. No. 4,779,249, and U.S. Pat. No. 5,332,135, address protection for the wristwatch itself. None were found which aimed at or mitigated the potential for the wristwatch to cause harm to persons other than the wearer that the wristwatch might contact, and many, because of their increased bulk and other factors appear to actually increase the possibilities that they will cause injury to persons, other than the wearer, that the watch might contact.

Applicants' reviews of numerous catalogs of wristwatch offerings and inspections of wristwatch displays in major stores have also failed to reveal any models which address the problems of injuries to persons other than the wearer, whom the watch may come in contact with when worn.

These absences suggest that there have been no commercially successful inventions which solved the problem addressed by the current invention.

U.S. Pat. No. 4,779,249 to Rappaport seeks to provide an inexpensive disposable wristwatch having at least one sealed chamber containing the watch works and other hermetically sealed chambers which may contain decorative or promotional elements. The wristwatch is constructed by encapsulating the watch works and possibly other decorative elements, in individual chambers formed of thermoplastic materials which are welded parametrically together to define the enclosing chambers. Rappaport's design, however, does not have flowing contours and surfaces substantially smooth to the touch. Rather, Rappaport has rapid and sudden changes in thickness, discontinuities (as in the notches between the chambers), and relatively sharp edges and corners. The outside edges of the parametric welds which form this wristwatch may also present particularly hard edges to persons with whom they may come in contact.

Moreover, Rappaport uses a hook and loop fastener catch to join the ends of his band together. However, such catches can scratch and scrape the skin. When closed, the catch is not smooth but rather creates a sharp discontinuity, with a more than doubling of the band thickness, i.e., two thickness of band plus the hook and loop fastener.

In typical designs of hook and loop fastener catches a longer length of the hook or loop fastener is provided on the portion of the strap which forms the underside of the clasp, when it is closed, than is provided on the end of the strap which forms the top of the clasp, in order to provide adjustment for various sizes of wrists. When this type of closure is worn by a person with a large wrist, a length of the hook or loop fastener remains entirely exposed when the clasp is closed, and when worn by a person with a small wrist the closure results in a longer double thickness of strap, plus hook and loop, which may also catch and snag.

U.S. Pat. No. 5,931,764 to Freeman et al. discloses a lightweight wearable multi-function device with a built-in display and is intended to improve upon other wearable devices which offer functions beyond the simple display of time. These kinds of functions include pedometric and physiological monitoring to joggers, smart card applications, health care information, cellular messaging services (the device may include a microphone and speaker), and so on. Although Freeman et al. states that his device "may be narrower than a smart card" it is clear that the device is large and bulky and not snag-free.

Wristwatches of the types used by hundreds of millions of wearers have display areas of sizes which may be incorporated in flexible bands without fear that they will break during normal flexing by the wearer. Freeman et al.'s device, however, requires a very large display to support and permit usage of the various functions of the device. The Freeman et al. display is so large that in order to be incorporated in a wearable and flexible device, the display element itself must be made flexible in order not to fail.

Freeman et al.'s display element must be adequate to show "medication and medical condition information" with their special requirements for readability and clarity, "animation sequences . . . a video clip or slide show", and "stereoscopic effects". All these functions require a large display area and requirements for easy to use control, which taken together, are major factors in establishing the dimensions of a large and bulky device.

Freeman et al.'s device is shown having a width that is relatively large compared to its length, and it is clear from the drawings that the device is large and bulky and hardly snag-free. Freeman et al. further uses a polymer edging 20 to "add comfort to a wearer" which indicates that the device is so large and bulky that users would find it uncomfortable to wear if the edging were not provided. The polymer edging also presents another surface that could harm a person other than the wearer. As is shown in Freeman et al.'s drawings, the device uses a clasp having protruding hooks or buckle rails on each side of one end of the strap. The other end of the strap slides under and engages these buckle rails. For this clasp to function, the portion of the strap which engages the rails must be relatively stiff and when engaged the strap must extend beyond the rails so that it can be grasped and pulled away to disengage the clasp. From a snagging perspective, with its protruding buckle rails and protruding strap, this design is potentially dangerous. Alternate clasps include a "peg and hole mechanism", i.e. a conventional buckle, and hoop and loop fasteners, each of which are bulky and non-snag free.

Because of its bulk, lack of smoothness and protrusions, Freeman et al.'s device could not be used in situations such as caring for the ill and aged where contact is frequent and the resultant injuries and contusions can be highly dangerous. Moreover, even if Freeman et al.'s device were to incorporate a snag free clasp such as a bayonet clasp, the device would still have a non-smooth surface and be overly large and bulky to accommodate the various input keys and electronic devices incorporated in the device.

In Freeman et al.'s design where no value is attached to snag-free characteristics, his selection of buckle and hook and loop fastener clasps are appropriate. Although not snag-free, such clasps provide a number of practical advantages over bayonet clasps. They are easily adjustable to a variety of wrist sizes, while the bayonet clasp is not. If Freeman et al.'s device were made with the bayonet clasp, a single size would not fit all users. Conversely, manufacture of Freeman et al.'s device in multiple sizes would add production, inventory and retailing complications and also added cost penalties. Manufacture of the device with the bayonet clasp would also involve modification to the molded or machined top and bottom layers of the strap to accommodate the bayonet clasp components. Uses of buckle and hook and loop fastener catches are, moreover, widely accepted on heart monitors and wrist-worn devices intended to be sold to joggers and for athletic pursuits, while use of a bayonet catch on such devices, with the added complication of sizing issues, might encounter consumer resistance. Because of these disadvantages and cost penalties, it is highly unlikely that one skilled in the art would use a bayonet clasp on Freeman et al.'s device.

U.S. Pat. No. 6,216,490 to Radley-Smith shows a wristwatch in which the display region is extended from the watch face to the bracelet itself, by use of a liquid crystal or LED (light emitting diode) elements either individually housed in a series of adjacent cases or in a single display unit extending along the bracelet.

Certain embodiments use a rigid bracelet which reflects Radley-Smiths's need to provide solid foundations for the liquid crystal and LED elements, to avoid flexing which could cause them to malfunction and break. Rigid bracelets are not snag-free and pose a risk to those other than the wearer with whom the watch comes in contact. When passing in sliding motions parallel to the axis of the wrist of the wearer, a rigid bracelet would, upon contact with another person, cant and cock and its hard edges would tend to injure. The opening in the "cuff" type rigid bracelet would also tend to catch and injure. The tang used in the hinge and clasp arrangements shown on certain embodiments of Radley-Smith's rigid bracelets is clearly a protruding element, likely to snag.

The remaining embodiments disclosed in Radley-Smith likewise show systems that have external stems and protruding elements, many sharp elements and abrupt changes in width and thickness, as in the meetings of the watch faces and bracelets, and the watch case to strap joints, and use of a conventional buckle. Some embodiments use a fabric wrap-around strap which carries a sequence of adjacent display elements and is provided with a hook and loop (Velcro) fastening. The extreme width of the strap to accommodate the closures would increase the likelihood of contact with persons other than the wearer. The high and irregular display elements protrude and present abrupt changes in thickness and non-continuous surfaces relative to themselves and each other. Similarly, the hook and loop closures present rough surfaces (exposed hook or loop closure), discontinuities, changes in thickness (double layers), etc.

U.S. Design Pat. No. 394,394 to Bruce shows an ornamental design wherein the portion of the band housing the display is configured in the form of an elongated "S", and the display itself is in the form of an ellipse, with its long axis essentially normal to the band. The central portion of the band which houses the display is formed in the shape of an arch which supports the watch case considerably above the wrist of the wearer. This structure is highly unusual, and the arch form is further repeated in the watch crystal or covering which is dome shaped.

The "S" arrangement and elliptical display area of the design as shown in Bruce necessarily results in a wristwatch which is far wider than one of more linear design. The placement of the watch case itself in the arch shaped structure above the wrist of the wearer and the added thickness of the dome shaped watch crystal or covering, compared to a crystal of flatter design, results in a wristwatch which at the location of the display is far thicker than the wristwatch would otherwise be without these features. These ornamental arrangements make the watch case and display itself a protruding element, in a band that has abrupt changes in width and thickness.

The great bulkiness of Bruce increases the likelihood that the wristwatch may come in contact with and harm persons other than the wearer. The central portion of Bruce's band must also be constructed of semi-rigid material in order to maintain the "S" configuration and the arch structure, and this required stiffness of the band in Bruce would further increase the probability of harm to others.

Moreover, Bruce's patent covers only the central portion of the wristwatch, but the rounded ends of the straps, illustrated in broken lines, suggest that the closure itself would be of the buckle type or possibly of the hook and loop fastener type. Means for control are not shown in Bruce's drawings, but these items might add, along with the closure, yet another protruding element to the design. Thus, Bruce's design is far from snag-free and is not free of protruding elements.

U.S. Pat. No. 6,388,612 to Neher discloses a bayonet-type clasp means, but the Neher device itself is far from snag-free and smooth in its entirety. The Neher patent shows a global positioning element in a wrist or ankle worn device, whereby the position of the wearer may be remotely monitored, anytime and anywhere. The wristband/tracking unit and the slide switch are protruding elements, its band is made of cut-resistant and rigid materials, high tensile strength plastic fiber and stainless steel, and the band has abrupt changes in width and thickness at the tracking unit, and square corners. Thus, not only is the Neher device not a wristwatch, the device is far from snag-free and cannot be used as a safety wristwatch system.

The main design criteria which led to Neher's use of the bayonet clasp included the need for a closure which was cut-resistant, tamper proof, conveniently lockable, and made of material compatible with the steel bracelet, and which could complete an electrical circuit in the bracelet when closed to indicate to a remote monitor whether the bracelet was intact or broken. The bayonet clasp probably best met these requirements, but even with this clasp the Neher device will not avoid causing injuries to persons other than the wearer.

U.S. Pat. No. 4,130,987 to Schickedanz shows a timepiece consisting of a bangle on which multiple small rigid panels consisting of liquid crystal display elements or the like are mounted around all or nearly all of the surface and which, when read together, may display time in various ways. The multiple inflexible display units are individually mounted on a flexible annular wristband which Schickedanz describes as a "closed annular wrist band being a flexible and stretchable annular wristband".

Schickedanz describes his elastic bracelet as "similar to a conventional elastic metal watch bracelet". Thus, although the Schickedanz timepiece may be flexible, the Schickedanz timepiece is far from snag-free and cannot function as a safety wristwatch. The number in the display units of Schickedanz may be countersunk in relation to their surfaces and there are multiple interstices between the display units which may scratch, cut, or tear persons other than the wearer. The drawings in Schickedanz, moreover, show many sharp edges on the rigid display material, and the timepiece appears to be rigid in the direction of the axis of the wrist of the wearer such that the bangle may cock and cause damage upon contact with a person other than the wearer.

Hence, although countless wristwatches are in existence, there is a need for a safety wristwatch that is aimed at benefitting persons in close contact with the wearer of the watch, particularly the ill, aged, and infants, who may be struck and injured by a conventional wristwatch.

Each year more than two million persons contract infections as a result of hospital care, and an estimated ten million patients are at risk in the United States annually for contracting a staph infection. The staph virus is common and is carried by many healthy persons. Staph infections can occur when the integrity of the skin barrier is broken through surgical procedures, scrapes and scratches, or in other ways, and they can cause serious and sometimes fatal illness in the most vulnerable, including newborns, certain diabetics, and the elderly. Staph bacteria are the number one cause of hospital infections, are becoming increasingly resistant to treatment, and are a serious public health problem. A safety wristwatch, if worn by care givers instead of ordinary wristwatches which frequently have sharp edges and are bulky and likely to injure, would avoid or reduce the possibilities that their wristwatch would strike and injure the persons in their care, or open a path for infection, and thus would provide considerable benefits to persons being cared for.

SUMMARY OF THE INVENTION

A safety wristwatch system free of protruding elements and external stems is provided which eliminates or greatly reduces the tendency that state of the art wristwatches have to snag or tear or damage the skin of persons other than the wearer. The entire wristwatch system is snag-free. The watch and controls, the materials of construction, the bracelet, bands or straps, shape, dimensions, fit, and the closures are all designed to avoid the potential in prior art wristwatches to cause skin damage to persons other than the wearer.

In one aspect, the safety wristwatch system includes a battery operated watch for displaying time, a pressure sensitive device operatively connected to the watch for control of the watch, and a band of flexible material attached to the watch for retaining the watch on a limb of a wearer.

The watch has an even surface devoid of roughness and projections. The pressure sensitive device is located below and adjacent to elastically deformable indents on the surface of the watch, which extend below the surface of the watch.

Preferably, the band has an upper surface and a lower surface. The lower surface may lie substantially in a first plane so that the band is flush with the limb of the wearer when worn. The upper surface may include side portions lying substantially in a second plane parallel to the lower surface and a center portion between the side portions, which may be raised above the second plane. The watch, the pressure sensitive device, and the band are without abrupt changes in width and thickness and have even continuous surfaces relative to themselves and to each other to prevent injuries and infection upon contact with persons other than the wearer.

In another aspect, a safety wristwatch system is provided which includes a band of flexible material attached to a battery operated watch for displaying time having an even surface devoid of roughness and projections. The band retains the watch on a limb of a wearer and has a surface meeting the surface of the watch with a flush joint. The thickness of the band is no greater than 0.4 cm.

A pressure sensitive device is operatively connected to the watch for control of the watch. The pressure sensitive device is located below and adjacent to elastically deformable indents on and extending below the surface of the watch.

The watch, the pressure sensitive device, and the band have a maximum width no greater than 3.25 cm, a maximum height when worn relative to the limb of the wearer no greater than 0.7 cm, and the watch, the pressure sensitive device, and the band are without abrupt changes in width and thickness and have even continuous surfaces relative to themselves and to each other to prevent injuries and infection upon contact with persons other than the wearer.

In one embodiment of the invention, the watch is attached to the band or bracelet, which is formed of one of a variety of flexible materials well known in the art. The watch meets the surface of the band to which it is attached with a smooth joint, nearly undetectable to the touch. The watch movement is battery operated and may be solar powered. Pressure sensitive devices are provided for control, including time setting, lighting, and operation of special features. The use of the pressure sensitive control devices, which may, for example be accessed via pressure points located at slight indents in the surface of the wristwatch, avoids the need for control stems and protruding buttons that are likely to snag.

Access to the watch is provided for battery replacement. The wristwatch is water resistant and washable to reduce the possibilities of transmission of disease in care giving situations.

In accordance with the invention, all dimensional changes in the width and thickness of the wristwatch are made gradually and smoothly, and bulkiness and protrudances that may snag are avoided. The bracelet or band may be continuous and of a stretchable or slip-on style, sized for various hand and wrist dimensions or provided with closures designed to avoid snagging. Closures may include the well-known bayonet type which is widely used in jewelry, seatbelts, and so on, which typically includes a spring-loaded latching device which engages by pushing the two mating pieces together. In jewelry, these types of closures are commonly released by pressing a protruding fin on the bayonet portion of the assembly. In accordance with the invention, however, the release pressure points are smoothly incorporated into the band, thus avoiding the use of protruding fins that might cause skin injuries. Other types of snag-free closures may also be used. The bracelet or band may be made of synthetic or natural materials suitably arranged to avoid snagging.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
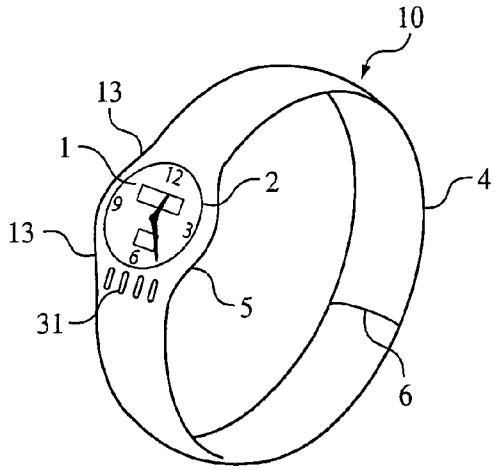
FIG. 1 is a perspective view of an embodiment of the invention positioned as if it were worn on the wrist but without the limb showing.

Referring now in detail to the drawings and, in particular, FIG. 1, a safety wristwatch system 10 free of protruding elements and external stems is shown according to a preferred embodiment. Although a wristwatch is illustrated, the invention may be applied to any limb worn instrument including a computer or medical monitoring device. The watch or other instrument preferably is water-resistant.

Safety wristwatch system 10 preferably includes a complete wristwatch in which all components are selected and designed to create a safe and snag-free wristwatch which, when worn, will present only smooth contours to persons other than the wearer whom the watch may contact and thus will not injure them or cause skin tear or damage.

On many occasions a thick or bulky wristwatch when worn by a person closely "brushing by" will strike and injure another person while a thinner wristwatch will pass clear. Similarly, a wider strap or band presents a wider striking surface making it more likely to strike a person other than the wearer during certain motions, greater width will generally increase the stiffness of the strap or band, and wristwatches having abrupt changes in dimensions and hard, sharp edges and projections are more likely to cause injuries when contacts occur. By contrast, the dimensions, shape, materials and elements of the safety wristwatch reduce the likelihood of contact with persons other than the wearer, and reduce the likelihood and severity of potential injury in the event of contact. By having, for example, preferably maximum band thickness of 0.4 cm, maximum width of 3.25 cm, preferably 3.0 cm, a preferable maximum height when worn relative to the limb of the wearer of 0.7 cm, for example 0.65–0.7, and a preferred ratio of maximum height to band thickness of 2 or less, injuries and infection upon contact with persons other than the wearer may be prevented.

Preferably, the height or thickness of wristwatch system 10 is in the range of 0.35–0.6 cm, for example 0.5 cm, and the band thickness is between 0.2–0.35 cm.

Safety wristwatch system 10 includes a battery operated or solar powered watch 1 having a face or display portion 2 which may be arranged for digital or analog display of time. Watch 1 has an even surface devoid of roughness and projections. System 10 also includes at least one pressure sensitive device 3 operatively connected to watch 1 for control of the watch, including setting of time, accessing date information, lighting the watch face and control of special features. In the embodiment shown in FIG. 1, pressing elastically deformable indents 31 in the watch activates the pressure sensitive device or devices 3 which are located below and adjacent to the indents. The indents are located on the surface of watch 1 and extend below the watch surface to activate pressure sensitive device or devices 3.

Figure 2:
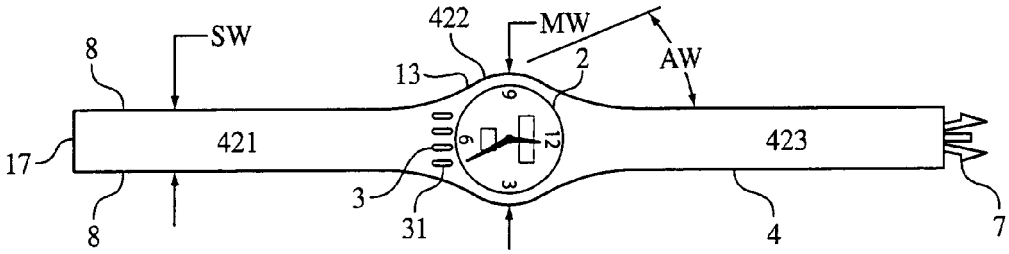
FIG. 2 is a plan view of the embodiment of FIG. 1 with the wristwatch system in an open and flattened position.
Figure 3:
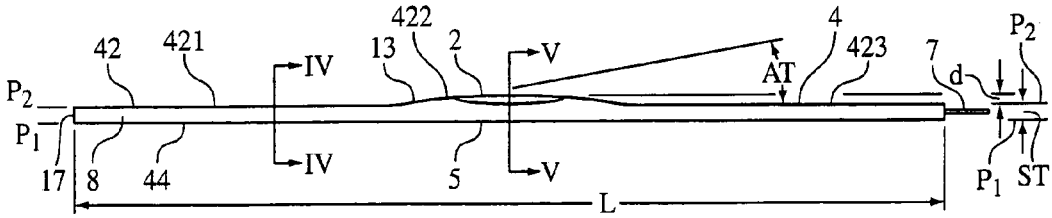
FIG. 3 is a side view of the embodiment shown in FIG. 2
Figure 5:
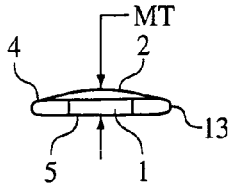

A band 4 which may be fashioned as a bracelet is attached to watch 1 for retaining watch 1 on a limb of a wearer. Band 4 may be continuous and stretchable to eliminate the need for clasps to secure portions of the band together. Watch 1 preferably is set in the band or bracelet 4 which may be fabricated from a variety of flexible materials well known in the art, including natural materials and synthetics including polymer-based materials. As shown in FIGS. 1–3, display 2 and exposed portions of watch 1 and adjacent portions of band 4 have substantially smooth and flowing contours. Ornamentation may be incorporated into watch 1 and band 4 so as to be visible within the surface of watch 1 and band 4. An access 5 may be provided in the back or underside of watch 1 for battery replacement when needed. As shown in FIG. 5, access 5 is snag-free and has substantially smooth and flowing contours when closed. Access 5 may be a door in the underside of watch 1, which is covered by lower surface 44 of band and is accessible to the user by removing watch 1 from band 4.

The embodiment of the band or bracelet shown in FIG. 1 shows a clasp 6, which is shown in further detail in FIGS. 2 and 3. As illustrated in FIGS. 2 and 3, clasp 6 includes a bayonet closure 7 which is released by squeezing the elastically deformable band into which the bayonet is inserted to activate the closure release 8. Band 4 includes a socket 17 for receipt of bayonet 7 which releases bayonet 7 upon activation of closure release 8 within and adjacent to the elastically deformable portions of band 4.

Figure 4:
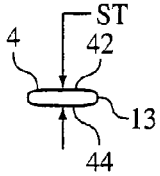
FIGS. 4 and 5 are cross-sectional views taken across planes IV—IV and V—V of FIG. 3, respectively

Band 4 has an upper surface 42 and a lower surface 44. As shown in FIG. 4, lower surface 44 lies substantially in a first plane $P_1$, so that band 4 is flush with the limb of the wearer when worn. Upper surface 42 includes side portions 421, 423 lying substantially in a second plane $P_2$ parallel to lower surface 44. Upper surface 42 also includes a center portion 422 between side portions 421, 423, which may be raised above second plane $P_2$ by a distance d preferably no greater than the distance ST between upper and lower surfaces 42, 44.

As shown in FIGS. 2 and 5, watch 1, pressure sensitive device or devices 3, and band 4 are without abrupt changes in width and thickness and have even continuous surfaces relative to themselves and to each other to prevent injuries and infection upon contact with persons other than the wearer.

Wristwatch system 10 preferably has maximum thickness MT no greater than 0.7 cm. For example, wristwatch system 10 may have a maximum thickness MT of 0.65 cm, 0.61 cm, 0.50 cm or 0.54 cm. Other ranges for thickness MT may be used, for example 0.5 to 0.7 cm or 0.35 to 0.6 cm.

Band 4 has a strap thickness ST within the range 0.2 to 0.4 cm, preferably 0.2–0.35 cm, and a strap width SW within the range 1.5 to 2 cm. The length L of band 4 may be such that when closed, watch 1 and band 4 form a circle having a circumference of between approximately 13 and 20 cm, for example 19 cm. For persons with small wrists, the circumference of the circle formed may be, for example, 14 cm. Longer or shorter lengths of band 4 may be chosen for different wrist sizes.

Any change in thickness of wristwatch system 1 as shown in FIG. 3 from plane $P_2$ or to the top of watch or center portion 422 which may occur is made gradually with a maximum included angle of change AT which does not exceed twenty degrees, for example ten degrees. In other words, the thickness of wristwatch system 1, where increased, rises at angles of twenty degrees or less from the band at plane $P_2$ to the top of watch 1.

Any change of width of wristwatch system 1 as shown in FIG. 2 from side portion 421 or 423 to center portion 422 is preferably constant or made gradually with a maximum included angle of change AW which does not exceed twenty-five degrees.

In other words, wristwatch system 1 may have no change in width or it may widen gradually with a maximum included angle of change AW of twenty-five degrees or less from side portion 421 or 423 to center portion 422. The maximum width MW of wristwatch system 10 is preferably no greater than 3.25 cm and preferably wristwatch system 10 has a maximum width MW within the range of 3.0 to 3.25, with a preferred width within the range of 2.0 to 2.9 cm.

Figure 6:
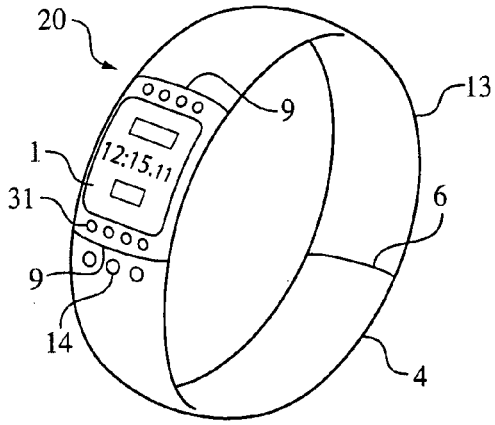
FIG. 6 is a perspective view of another embodiment of the invention.
Figure 7:
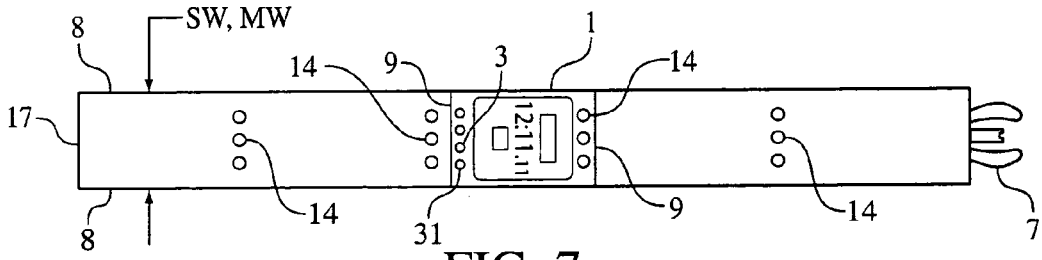
FIG. 7 is a plan view of the embodiment of FIG. 6 with the wristwatch system in an open and flattened position.
Figure 8:
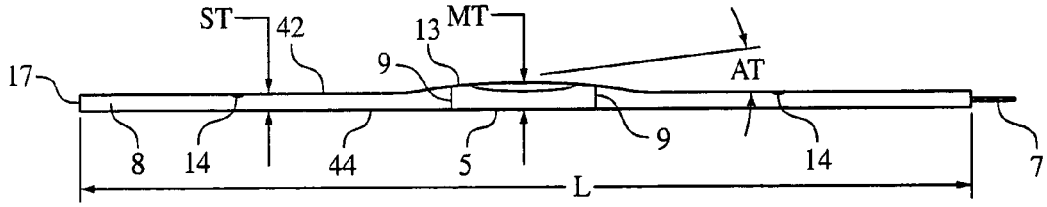
FIG. 8 is a side view of the embodiment shown in FIG. 7.

FIGS. 6 through 8 show a second embodiment of a safety wristwatch system 20 free of protruding elements and external stems.

Wristwatch system 20 includes a battery operated watch 1 for displaying time having an even surface devoid of roughness and projections. Wristwatch system 20 also includes at lease one pressure sensitive device 3 operatively connected to watch 1 for control of the watch. Pressure sensitive device or devices 3 are located below and adjacent to elastically deformable indents on the surface of watch 1 which extends below the surface of watch 1.

A band 4 of flexible material is attached to watch 1 for retaining the watch on a limb of a wearer. Band 4 has a surface 42, 44 meeting the surface of watch 1 with a flush joint. For example, FIGS. 6–9 show watch 1 connected to band or bracelet 4 by snag-free attachments 9. Jewels and ornamentation 14 are also shown, which may include precious gems embedded so as to be visible although below the smooth surface of the watch.

Band 4 preferably has a band thickness ST no greater than 0.4 cm, preferably between 0.3 and 0.4 cm, most preferably between 0.2 and 0.35 cm. Watch 1, pressure sensitive device or devices 3, and band 4 have a maximum width MW no greater than 3.25 cm, for example 3.0–3.25 cm, and a maximum height MT when worn relative to the limb of the wearer no greater than 0.7 cm, for example 0.65–0.7 cm maximum height or thickness MT. Preferably, the ratio of maximum height to band thickness (MT/ST) no greater than 2. Watch 1, pressure sensitive device or devices 3, and band 4 are without abrupt changes in width and thickness and have even continuous surfaces relative to themselves and to each other to prevent injuries and infection upon contact with persons other than the wearer.

Preferably, watch 1, pressure sensitive device or devices 3, and band 4 have a width MW between 2.0 and 2.9 cm and a height when worn MT relative to the limb of the wearer between 0.35 and 0.6 cm, for example 0.5 cm, but may have other ranges, such as 0.54–0.61 cm.

As in the first embodiment, the maximum angle change of thickness AT is twenty degrees and the maximum angle change of width AW is twenty-five degrees. In the embodiment shown in FIGS. 6–8, the change of width is zero so band width SW equals the maximum width (MW) of wristwatch system 20.

Figure 9:
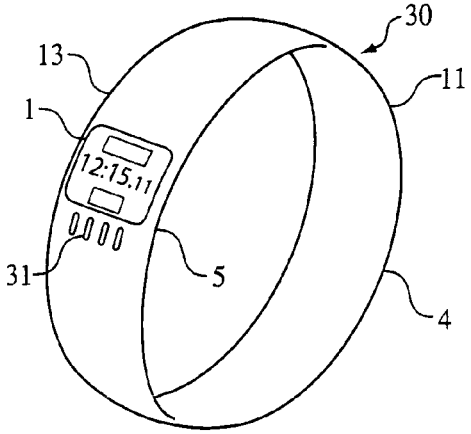
FIG. 9 is a perspective view of a third embodiment of the invention.
Figure 10:
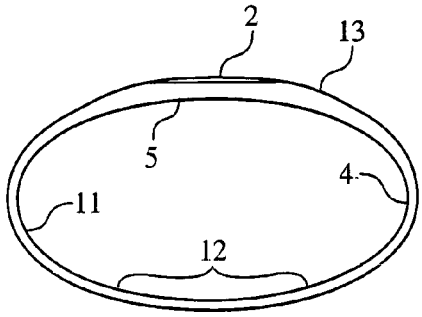
FIG. 10 is a side view of the embodiment shown in FIG. 9

FIGS. 9–10 show a further embodiment of a safety limb-worn instrument system 30 according to the invention free of protruding elements and external stems.

System 30 includes an instrument 1, at least one pressure sensitive device 3 operatively connected to instrument 1 for control of the instrument, and a band 4 of flexible material attached to instrument 1 for retaining the instrument on a limb of a wearer.

Instrument 1 may be a computer, a medical monitoring device, or a watch for displaying time and includes a source of power for operating instrument 1.

Pressure sensitive device or devices 3 are located below and adjacent to elastically deformable indents near instrument 1 as shown in FIG. 9.

Band 4 may be a continuous bracelet as shown in FIG. 9 and may have at least a stretchable portion 12 shown in FIG. 10 to facilitate putting the system on and off a limb of a wearer.

As in the previous embodiments, band 4 preferably has a band thickness no greater than 0.4 cm, preferably 0.2–0.35 cm, and the entire system 30, including instrument 1, pressure sensitive device or devices 3, and band 4, has a maximum width no greater than 3.25 cm, for example 3.0–3.25 cm, preferably 2.0–2.9 cm, a maximum height when worn relative to the limb of the wearer no greater than 0.7, for example 0.65–0.7 cm, preferably 0.35–0.5 cm, and preferably a ratio of maximum height to band thickness no greater than 2. Instrument 1, pressure sensitive device or devices 3, and band 4 are without abrupt changes in width and thickness and have even continuous surfaces relative to themselves and to each other to prevent injuries and infection upon contact with persons other than the wearer.

As in the previous embodiments, the maximum angle of the change of thickness is twenty degrees and the maximum angle of the change in width is twenty-five degrees.

FIGS. 1–10 are intended to convey the smoothness of line and snag-free arrangements of the invention. The designation 13 for the contours are indicated repeatedly in FIGS. 1–10, and are used to indicate and emphasize that all external surfaces of the wristwatch or other instrument are substantially smooth to the touch and rounded or curved with flowing contours and without excessively high profiles or hard, sharp edges or projectiles which might catch on and injure the skin or persons whom the wearer of the watch might contact.

Possible embodiments of the invention may include, but are not limited to, continuous bracelets, slip on bracelets, stretchable bracelets, sized bracelets, stretchable bracelets, sized bracelets, and combinations thereof, various types of clasps, and bracelets with linked connections to the watch or other instrument, and use of the snag-free form for multi-functional and special use purposes, including medical monitoring designed in the form of a wristwatch, provided that in all cases the designs result in a snag-free system.

Accordingly, while several embodiments of the present invention have been shown and described, it is to be understood that many changes and modifications may be made thereunto without departing from the spirit and scope of the invention as defined in the appended claims.

What is claimed is:

1. A safety wristwatch system free of protruding elements and external stems, which comprises:

(a) a battery operated watch for displaying time having an even surface devoid of roughness and projections;

(b) at least one pressure sensitive device operatively connected to said watch for control of said watch, said at least one pressure sensitive device being located below and adjacent to elastically deformable indents on the surface of said watch, said indents extending below the surface of said watch; and (c) a band of flexible material attached to said watch for retaining said watch on a limb of a wearer, said band having an upper surface and a lower surface, said lower surface lying substantially in a first plane so that said band is flush with the limb of the wearer when worn, said upper surface comprising side portions lying substantially in a second plane parallel to said lower surface and a center portion between said side portions raised above said second plane by a distance no greater than the distance between said upper and lower surfaces, said watch, said at least one pressure sensitive device, and said band have a maximum width no greater than 3.25 cm and a maximum height when worn relative to the limb of the wearer no greater than 0.7 cm, said watch, said at least one pressure sensitive device, and said band being without abrupt changes in width and thickness and having even continuous surfaces relative to themselves and to each other to prevent injuries and infection upon contact with persons other than the wearer.

2. The safety wristwatch system according to claim 1 further comprising snag-free access means for replacing said battery, said access means having substantially smooth and flowing contours when closed.

3. The safety wristwatch system according to claim 1 further comprising snag-free clasp means having substantially smooth and flowing contours when closed.

4. The safety wristwatch system according to claim 3 wherein said clasp means comprises a bayonet, a socket for receipt of said bayonet, and a closure release within and adjacent to elastically deformable portions of said band near said socket.

5. The safety wristwatch system according to claim 1 wherein said wristwatch system is water-resistant.

6. The safety wristwatch system according to claim 1 wherein said band is continuous and stretchable.

7. The safety wristwatch system according to claim 1 wherein said watch is set in said band, with the display and exposed portions of said watch and adjacent portions of said band having substantially smooth and flowing contours.

8. The safety wristwatch system according to claim 1 further comprising ornamentation incorporated into said watch and said band so as to be visible within the surface of said watch and said band.

9. A safety wristwatch system free of protruding elements and external stems, which comprises:

(a) a battery operated watch for displaying time having an even surface devoid of roughness and projections;

(b) at least one pressure sensitive device operatively connected to said watch for control of said watch, said at least one pressure sensitive device being located below and adjacent to elastically deformable indents on the surface of said watch, said indents extending below the surface of said watch;

(c) a band of flexible material attached to said watch for retaining said watch on a limb of a wearer, said band having a surface meeting said surface of said watch with a flush joint and having a band thickness no greater than 0.4 cm;

wherein said watch, said at least one pressure sensitive device, and said band have a maximum width no greater than 3.25 cm, a maximum height when worn relative to the limb of the wearer no greater than 0.7 cm, and a ratio of maximum height to band thickness no greater than 2 so that said watch, said at least one pressure sensitive device, and said band being without abrupt changes in width and thickness and having even continuous surfaces relative to themselves and to each other to prevent injuries and infection upon contact with persons other than the wearer.

10. The safety wristwatch system according to claim 9 wherein said watch, said at least one pressure sensitive device, and said band have a width between 2.0 and 2.9 cm and a height when worn relative to the limb of the wearer between 0.35 and 0.6 cm.

11. The safety wristwatch system according to claim 9 wherein said watch, said at least one pressure sensitive device and said band have a height when worn relative to the limb of the wearer no greater than 0.65 cm and a width no greater than 3.0 cm, and said band has a width between 1.5 and 2.0 cm.

12. A safety limb-worn instrument system free of protruding elements and external stems, which comprises:

(a) an instrument selected from the group consisting of a computer, a medical monitoring device, and a watch for displaying time, said instrument comprising a source of power for operating said instrument;

(b) at least one pressure sensitive device operatively connected to said instrument for control of said instrument, said at least one pressure sensitive device being located below and adjacent to elastically deformable indents near said instrument; and (c) a band of flexible material attached to said instrument for retaining said instrument on a limb of a wearer, said band having a band thickness no greater than 0.4 cm;

wherein said instrument, said at least one pressure sensitive device, and said band have a maximum width no greater than 3.25 cm, a maximum height when worn relative to the limb of the wearer no greater than 0.7 cm, and a ratio of maximum height to band thickness no greater than 2 so that said instrument, said at least one pressure sensitive device, and said band being without abrupt changes in width and thickness and having even continuous surfaces relative to themselves and to each other to prevent injuries and infection upon contact with persons other than the wearer.

* * * * *